US006631830B2

(12) United States Patent
Ma et al.

(10) Patent No.: US 6,631,830 B2
(45) Date of Patent: Oct. 14, 2003

(54) SNAP ACTION BALL VALVE ASSEMBLY AND LIQUID DISPENSER USING SAME

(75) Inventors: Chor Ming Ma, Shatin (CN); George L. Skinner, Lake Hiawatha, NJ (US); Jeffrey Zimmerman, King of Prussia, PA (US)

(73) Assignee: Larami Limited, Mt. Laurel, NJ (US)

( * ) Notice: Subject to any disclaimer, the term of this patent is extended or adjusted under 35 U.S.C. 154(b) by 0 days.

(21) Appl. No.: 09/933,702

(22) Filed: Aug. 20, 2001

(65) Prior Publication Data

US 2003/0034358 A1 Feb. 20, 2003

(51) Int. Cl.[7] ..... A63H 3/18
(52) U.S. Cl. ..... 222/79; 251/75
(58) Field of Search ..... 222/79, 95, 380, 222/401; 251/75

(56) References Cited

U.S. PATENT DOCUMENTS

| | | | |
|---|---|---|---|
| 3,197,070 A | 7/1965 | Pearl et al. | |
| 4,214,674 A | 7/1980 | Jones et al. | |
| 4,735,239 A | 4/1988 | Salmon et al. | |
| 4,854,480 A | 8/1989 | Shindo | |
| 5,074,437 A | 12/1991 | D'Andrade et al. | |
| 5,322,191 A | 6/1994 | Johnson et al. | |
| RE35,412 E | 12/1996 | Johnson et al. | |
| 5,758,800 A | 6/1998 | D'Andrade | |
| 5,875,927 A | 3/1999 | D'Andrade | |
| 5,339,987 A | 10/2000 | D'Andrade | |
| 6,138,871 A | 10/2000 | D'Andrade | |
| 6,158,619 A | 12/2000 | D'Andrade et al. | |
| 6,167,925 B1 | 1/2001 | D'Andrade et al. | |
| 6,345,732 B1 * | 2/2002 | Zimmerman et al. | 222/79 |
| 6,364,219 B1 | 4/2002 | Zimmerman et al. | |
| 2002/0020712 A1 * | 2/2002 | Hornsby et al. | 222/79 |

FOREIGN PATENT DOCUMENTS

WO WO 00/76670 A1 12/2000

OTHER PUBLICATIONS

Super Soaker™ 300, "The Big One," Larami Corp. Catalog, Cover page and pp. 2 and 3 (Fall 1993);.
XP–250 Super Soaker™, and XP–300 Super Soaker™, Larami Corp. Catalog, Cover page and pp. 7 and 8 (Spring/Summer 1995); and.
Super Soaker™ XXP–275, Larami Limited Catalog, Cover page and p. 27 (1996).

* cited by examiner

*Primary Examiner*—Gene Mancene
*Assistant Examiner*—Melvin A. Cartagena
(74) *Attorney, Agent, or Firm*—Akin Gump Strauss Hauer & Feld, L.L.P.

(57) ABSTRACT

A spring-controlled snap action valve assembly and an apparatus for dispensing pressurized liquid using the valve assembly, the apparatus including a connection to a source of pressurized liquid, the spring-controlled snap action ball valve assembly including a snap action ball valve and an inlet and an outlet, a conduit in fluid communication from the connection to the valve assembly inlet, a nozzle in fluid communication with the valve assembly outlet, and an actuator connected to the valve assembly to actuate the snap action ball valve from a closed position to an open position and from an open position to a closed position.

32 Claims, 7 Drawing Sheets

SNAP ACTION BALL VALVE ASSEMBLY AND LIQUID DISPENSER USING SAME

BACKGROUND OF THE INVENTION

The present invention relates to a snap action ball valve assembly, and more particularly to a spring-controlled snap action ball valve assembly and the use of the valve assembly in apparatus for dispensing liquids, preferably pressurized liquids. Still more particularly, the valve assembly of the present invention is well suited for use in toy water guns and especially toy water guns in which the water is air-pressurized or is pressurized by the elastic force of an elastic bladder. The valve assembly of the present invention has open and closed valve positions in which the valve is switchable substantially instantaneously upon appropriate activation from a closed position to an open position and from an open position to a closed position.

There are a large number of different valve structures used to control the flow of liquid in all types of apparatus. Some valves allow different flow volumes by allowing the user to control the extent to which a valve opens and closes. Other valves are full open or full closed. The valve assembly of the present invention is of the latter type. The valve assembly can be used in all types of applications, particularly where control of pressurized liquids, that is, the flow of the liquid is controlled by a motive force, such as a pump, by air pressure or an elastic bladder. The present invention will be described with respect to its use in toy water guns.

Water guns for decades have been very popular toys. The most traditional form of water gun is a single stroke water gun that uses a small pump within the housing of the water gun to pump a small amount of water from water contained in the housing through various conduits connected to a nozzle at the front of the water gun where each pull of a trigger activates a pump stroke to shoot one small stream of water at a time from the water gun. These water guns are limited in the distance the water travels, the amount of water projected and the duration of the pumping cycle. In some instances, battery-operated motors activate the pumps when a trigger is depressed, but such battery-operated water guns still typically are subject to the same problems as the fully manually operable water guns. The primary advantage of battery operated water guns is that they are capable of rapid fire pump strokes based on the operation of the motor, or in some instances, a continuous pump action by which the battery-operated motor is activated for as long as the trigger is depressed. In both of the single stroke and battery operated water guns, the conduit leading from the pump to the nozzle typically is not controlled by any valve, since a valve is not necessary because the water is only being forced through the gun by the action of each individual pump stroke or by the activation of the pump motor.

In an attempt to improve upon water guns, so as to increase the distance the water travels when shot from the gun and to increase the duration of the time of an individual stream of water being shot, the toy industry has developed pressurized water guns which work on the principle of the pressure differential between the water in the water gun and atmospheric pressure. In pressurized water guns, water in the water gun is at a pressure higher than the pressure of the ambient atmosphere. As a result, when the water within the water gun is open to the atmosphere, typically by opening a valve in a conduit between the source of pressurized water and a nozzle, the water will stream out of the water gun under pressure. Thus, the use of a valve to release water to the nozzle is essential in pressurized water guns. There are two general types of pressurized water guns.

A first type of pressurized water gun traps water in a collapsible area where, as the collapsible area expands, a force is created on the water, such as by an elastic bladder. The collapsible area or bladder is filled with water under pressure, such as from a municipal water source or by pumping the water from a reservoir, using a remotely located pump or a pump contained on the water gun. During the fill cycle and until the water is desired to be shot, a valve between the pressurized water source and the nozzle is closed so that the water cannot escape from the water gun. When it is desired to shoot water from the gun, the valve is opened, typically by an actuator connected to a trigger, so that as the collapsible area is collapsed or as the elastic bladder contracts to its pre-expanded size, water is expelled from the gun under pressure. Typical of these types of water guns are those disclosed in U.S. Pat. Nos. 3,197,070, 4,735,239 and 4,854,480, as well as several SUPER SOAKER® CPS™ bladder-type water guns sold by Larami Limited. These types of water guns generally provide a constant pressure for the water being shot from the guns until the supply of water within the bladder is effectively exhausted. Various embodiments of the Larami Limited types of water guns are disclosed in U.S. Pat. No. 5,758,800, in which the bladder is charged from a water reservoir mounted on the water gun with a hand pump also located on the water gun. U.S. Pat. No. 6,158,619 is an example of a water gun in which bladders are contained in a backpack that can be filled by a quick charging device using water from a municipal water source. The hand-held component in this product in essence is an assembly comprising a trigger-activated valve and a nozzle through which a stream of water is dispensed. U.S. Pat. No. 6,167,925 discloses another type of bladder of water gun in which water used to fill a bladder may be pumped from a water tank in which the water tank and pump are located on or in the housing of the water gun, and also from a municipal water source using a quick charge device.

The other general type of pressurized water gun uses air pressure to force water through a nozzle. The air is pressurized using a pump that can be remote from the hand-held water gun or on or in the housing of the hand-held water gun. As with the first type of water guns, the water is shot from the guns by using a trigger actuator to open a release valve located between the pressurized water source and the nozzle. An example of a device using a remote pump is U.S. Pat. No. 4,214,674. Another example of a water gun using both an on-board water tank and air pump is U.S. Pat. No. 5,074,437, typical of Larami Limited's original SUPER SOAKER® water guns exemplified by the SUPER SOAKER® 50 model water gun.

Other water guns in the air pressurized category operate under the principle disclosed in U.S. Pat. Nos. Re. 35,412 and 5,322,191, by which water from an unpressurized source, such as a pool of water or a vented water tank that may be mounted on the water gun, may be pumped by a pump that likewise may be mounted on the water gun to a pressurized tank initially containing air. As the water is pumped from the vented water tank to the pressurized tank, the air in the pressurized tank is compressed, providing a motive force for the water, which is shot from the gun upon opening of a trigger-controlled release valve. U.S. Pat. No. 6,138,871 discloses a toy water gun in which the source of water in a pressurized tank is from an external water supply, such as a municipal water supply. A quick charging device allows water from the municipal water supply to fill a pressurized tank initially containing air such that the air is compressed and acts as a motive force to eject water from the gun upon opening of a trigger-controlled release valve. In the water gun disclosed in this patent, an air pump mounted within the housing of the water gun is used to pump additional compressed air into the air pressure water tank so that there will be enough compressed air to expel substantially all of the water from the pressurized tank.

With all of the air pressurized water guns, the duration and distance of the stream of water being shot from the water guns are based on the amount and pressure of the air used as the motive force. When the pressure of the air used as a motive force for the water reaches the pressure of the ambient atmosphere, water is no longer propelled from the guns.

The pressurized water guns produced commercially and disclosed in patents use various types of valves to release the water to the nozzle. Typical are pinch valves, in which a flexible conduit is pinched by a spring-controlled clamp to close the water pathway and in which pulling the trigger opens the clamp. Water guns also often use plug valves, in which a plug is retained by a spring in a valve seat when the valve is closed. Upon actuation of the trigger, the valve is pulled or in some instances pushed away from the valve seat, to allow water to be shot from the gun.

U.S. Pat. No. 5,339,987 discloses an improved release valve structure and mechanism by which a linkage from the trigger is connected by a delay spring to a valve, typically a plug valve, wherein the valve housing allows water pressure to build up behind the valve before it is opened. Based on this mechanism, when the force of the water pressure and the delay spring is overcome when the trigger is pulled, a burst of water is released from the water gun. Upon releasing pressure on the trigger, the valve closes until it is desired to release another burst of water upon depressing the trigger again. The trigger can remain depressed as long as desired and as long as there is an adequate source of motive force, such as by air pressure or in other embodiments, by pressure from an elastic bladder, water will be expelled from the gun.

The controlled flow, bursting water gun release mechanism of U.S. Pat. No. 5,339,987 was an improvement over prior types of release valves. However, even with this release valve, and to a greater extent in the prior valves like the pinch valves, there is a drop off of pressure upon opening and just before closing the valve that is not directed to usefully expelling water from the guns with the full pressure force. Also, these type of water guns have the flow of water through the guns and especially in and around the valves subjected to turbulence created by the water flow path in the valve and in the connection between the conduit from the pressurized water supply to the valve. The drop off in pressure occurs due to the slight delay between the full opening and the final closing of the valve. As the pressure drops off, there is less pressure available to provide a motive force for the water being shot from the gun. Moreover, because of the structure of many release valves, there is not a direct flow path of water through the release valve, which causes turbulence, which adversely affects the flow of water through the valve and out the nozzle. The turbulence increases as the size of the release valve increases. With the trend toward larger water guns, release valves and nozzles, to allow larger amounts of water to be shot from the water guns, increasing the play value, the pressure drop off and turbulence are becoming greater concerns, limiting the distance, duration or both of the water stream being shot from the water guns.

The spring-controlled snap action ball valve assembly of the present invention overcomes these concerns for toy water guns and for any other apparatus for dispensing pressurized liquid. Using this valve assembly of the present invention, turbulence and pressure changes that significantly adversely affect the flow of liquid to be dispensed from the apparatus are substantially eliminated. This provides the apparatus with a better controlled release of the liquid, for a longer distance and greater duration than if prior art valves were used for the pressurized dispensing apparatus. When used in the exemplified application of toy water guns, the snap action ball valve assembly of the present invention could be used effectively for all types of pressurized water guns or other type of pressurized liquid dispensers, whether they operate under the principle of air pressure or collapsible space, such as provided by an elastic bladder. Moreover, the valve assembly of the present invention has use in any kind of liquid dispensing apparatus whether the source of pressurized liquid is attached to or contained within the same housing as the housing containing the valve assembly or externally remote from such housing.

BRIEF SUMMARY OF THE INVENTION

One aspect of the present invention relates to an apparatus for dispensing pressurized liquid, the apparatus comprising a connection to a source of pressurized liquid, a spring-controlled snap action ball valve assembly including a snap action ball valve, an inlet and an outlet, a conduit in fluid communication from the connection to the valve assembly inlet, a nozzle in fluid communication with the valve assembly outlet, and an actuator connected to the valve assembly to actuate the snap action ball valve from a closed position to an open position and from an open position to a closed position.

Another aspect of the present invention relates to a spring-controlled snap action ball valve assembly comprising a valve housing with a flow path through the valve housing, the valve housing having an inlet and an outlet, a ball valve member having a channel therethrough and being rotatable within the valve housing, the channel having an inlet end and an outlet end and being aligned with the valve housing inlet and valve housing outlet in an open valve position and not being aligned with the valve housing inlet and valve housing outlet in a closed valve position, a liquid-tight seal adjacent each of the valve housing inlet and valve housing outlet and each bearing against the ball valve member, a shaft connected to the ball valve member and extending out of the valve housing to rotate the ball valve member in the valve housing, a ball lever having two ends and connected at one end to the shaft, a snap lever movable with respect to the ball lever, the snap lever being connected at least indirectly to the actuator, and a spring connecting the snap lever and the ball lever at a location spaced from the one end of the ball lever where the ball lever is connected to the shaft, the spring having a spring action, the spring action and the relative movement of the snap lever and the ball lever being interrelated such that movement of the actuator in a first direction causes the snap valve to move from a first snap lever position to a second snap lever position and thereby causing a first effectuation of the spring action, the first effectuation of the spring action in turn causing the ball lever to snap from a first ball lever position where the ball valve member is in the closed valve position to a second ball lever position where the ball valve member is in the open valve position, and the movement of the actuator in a second direction causes the snap valve to move from the second snap lever position to the first snap lever position, thereby causing a second effectuation of the spring action, the second effectuation of the spring action in turn causing the ball lever to snap from the second ball lever position where the ball valve is in the open valve position to the first ball lever position where the ball valve is in the closed valve position.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments, which are presently preferred. It should be understood, however, that the invention is not limited to the precise arrangements and instrumentalities shown.

In the drawings.

DETAILED DESCRIPTION OF THE INVENTION

Figure 1:
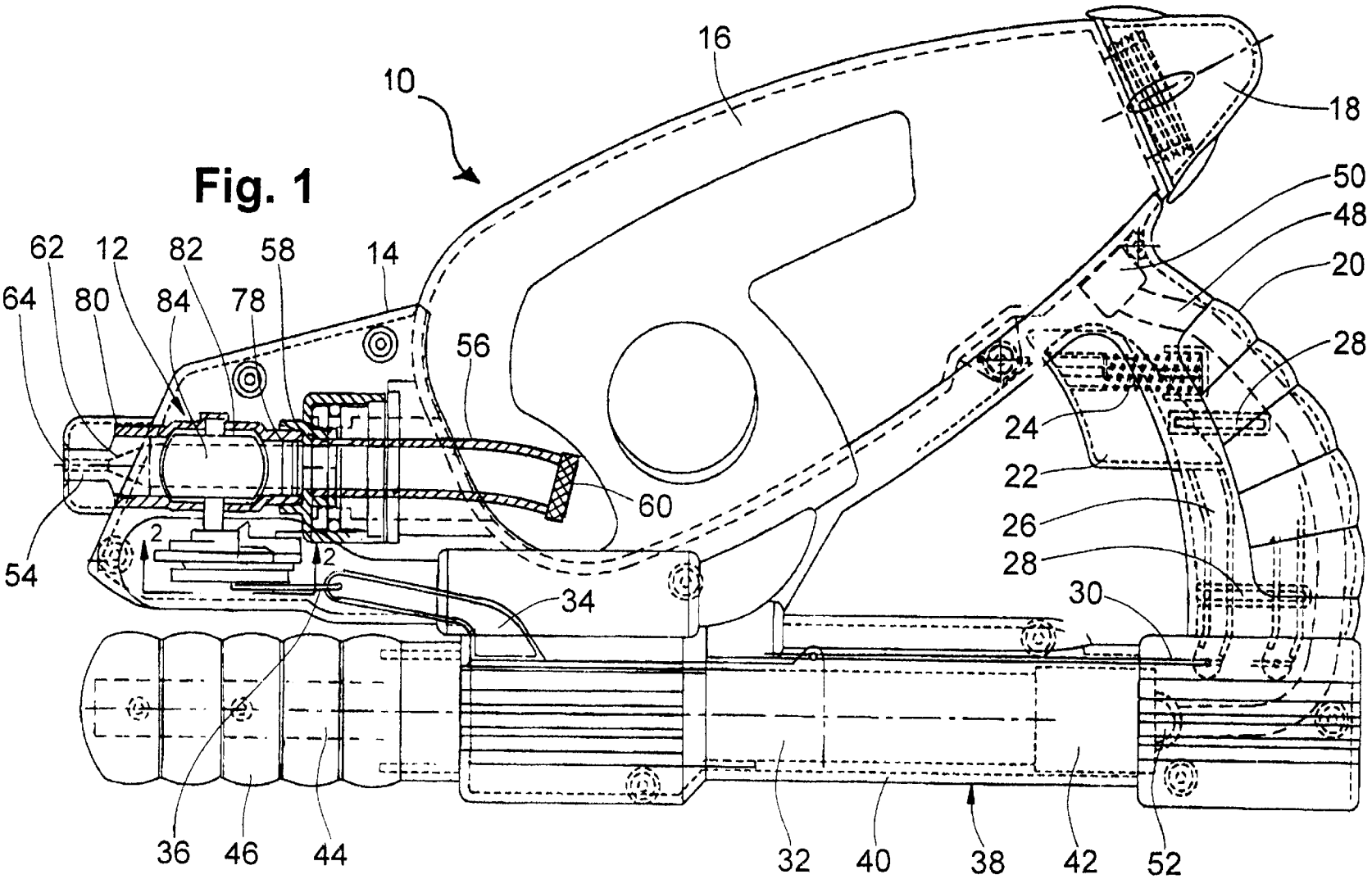
FIG. 1 is a left side elevational view, partially in vertical cross section, and partially with portions of the housing removed, showing one embodiment of a toy water gun including the spring-controlled snap action ball valve assembly in accordance with the present invention.

Certain terminology is used in the following description for convenience and is not limiting. The words "right", "left", "lower", and "upper" designate directions in the drawings to which reference is made. The words "front", "rear", "bottom", and "top" designate directions with respect to the apparatus in which the valve assembly of the present invention is used, such as the exemplary water gun illustrated in FIG. 1. The indicated terminology includes the words noted above, as well as derivatives thereof and words of similar import.

As used herein, the article "a" is used to designate one or more than one component or unit, unless only a single component or unit is specifically indicated.

In a basic aspect, the present invention relates to a new valve assembly for use in any type of apparatus in which the flow of liquid is desired to be either off or on and where the valve switches substantially instantaneously from closed to open and from open to closed upon being actuated to the desired condition.

Another aspect of the present invention is the use of the valve assembly in a pressurized liquid dispensing apparatus. The typical application is where the dispensing apparatus dispenses a pressurized liquid in such diverse applications as toy water guns, paint sprayers, insecticide sprayers, high pressure liquid cleaning apparatus, and various other domestic, commercial and industrial types of apparatus. The liquid may be pressurized by a pump, by air pressure or by an elastic bladder that provides a pressurizing force when the bladder is expanded with the liquid contained in it.

Common to all of the apparatus, besides including a spring-controlled snap action ball valve assembly of the present invention is that the apparatus be for dispensing a liquid, preferably a pressurized liquid, including a connection to a source of pressurized liquid, a conduit in fluid communication from the connection to an inlet of the valve assembly, a nozzle in fluid communication with an outlet from the valve assembly, and an actuator connected to the valve assembly to actuate the snap action ball valve from a closed position to an open position and from an open position to a closed position. The apparatus also preferably includes a device for pressurizing liquid to be dispensed from the apparatus, where the device may be a pump in fluid communication with a source of liquid, a pump for compressing air to provide a motive force to the liquid or an elastic bladder connected to a source of liquid.

Additionally, the source of compressed liquid may include a tank for liquid and air compressed by a pump, where the air exerts a force on liquid in the tank to force a liquid into the conduit connected to the source of pressurized liquid. The tank may be attached to a toy water gun housing, and typically, the actuator connected to the valve assembly is actuated by a trigger, where the trigger is typically adjacent to or partially extends within a handle that forms a part of or is connected to the housing. The toy water gun may include a pump, which is attached to the water gun housing and wherein the pump may be an air pump or a water pump. The tank may be at least partially within the water gun housing or external to the water gun housing and connected directly to the housing or remote from the housing.

In an apparatus in which the motive force for pressurizing the liquid is a bladder, such as a toy water gun, the toy water gun may include a housing, a tank for water that may be attached to or at least partially within the water gun housing, or a tank which is remote from the housing. As with the air pressurized water guns, the actuator is typically actuated by a trigger adjacent to or partially within a handle that is formed with or connected to the housing.

The apparatus using the ball valve assembly of the present invention may further include a tank for liquid, an elastic bladder or both a tank and a bladder, as well as a quick fill device connectable to the source of pressurized liquid and removably associated with an inlet valve in a conduit in fluid connection with the tank or the elastic bladder.

A preferred type of apparatus includes toy water guns. Accordingly, the present invention will be described with respect to toy water guns, and especially pressurized water guns in which a compressed air source or an elastic bladder pressurizes the water.

Representative of various types of air pressurized water guns with which the valve assembly of the invention could be used are, for instance, U.S. Pat. Nos. 5,074,437, Re. 35,412, 5,322,191, 5,339,987 and 6,138,871, the disclosures of which are all incorporated herein by reference. These patents disclose air pressure water guns in which air is pumped into a sealed tank containing water, or where water is pumped from a vented water tank to a sealed tank containing air to compress the air, and where water tanks are removable from the gun, permanently affixed to the gun, or remotely located from the gun, and further, where pressurized water can be forced into the gun from a municipal pressurized water source through a quick charge device. Thus, the particular type of air pressure water gun (or other liquid dispensing apparatus) is not critical, so long as such water gun or other apparatus uses the valve assembly of the present invention.

Similarly, representative examples of pressurized water guns in which the water is pressurized using an elastic bladder are exemplified by the following U.S. Pat. Nos. 6,158,619, 5,758,800, 5,875,927 and 6,167,925, as well as International Patent Application Publication No. WO 00/76670 A1, corresponding to U.S. patent application Ser. No. 09/59 1,379. The subject matter of all of these patents and patent applications is hereby incorporated herein by reference. These patents and applications are representative of various different styles and structures of bladder water guns in which the bladder can be expanded by water being pumped from a water tank that is part of or remote from the water gun, where water is pumped from the tank by a pump that is part of or remote from the water gun, or where water is charged directly into the bladder from a pressurized municipal water source through a quick charge device, for example.

Even in water guns, for example, the snap action ball valve assembly could be substituted for any of the water release valves used in any of the water guns referenced in the patents or by commercial use mentioned above in the Background of the Invention section, and these are all hereby incorporated by reference herein. With the foregoing in mind, FIG. 1 shows a water gun 10 including a spring-controlled snap action ball valve assembly 12 of the present invention, located within a water gun housing 14, typically made of a synthetic polymeric material, such as acrylonitrile-butadiene-styrene (ABS), although many other suitable materials may be used. Typically, the water gun housing and its components are made by molding processes, such as injection molding, blow molding, etc., all of which are standard processes. Water gun housing 14 may be formed as mating halves which, after the various components are inserted into the housing, may be screwed together or attached by adhesive, solvent bonding, or other suitable means.

Water gun 10 also includes a tank 16 for containing a liquid, preferably water. Tank 16 may be made of any suitable material, preferably a synthetic polymeric material that is readily made by blow molding, such as high density polyethylene, for example without limitation. Tank 16 includes a removable cap, such as a screw cap 18, which screws onto a threaded portion of the water tank. The water tank may be externally attached to or as illustrated, partially within, housing 14. If desired, instead of having a removable cap 18, the entire tank 16 could be removable as described, for example, in U.S. Pat. No. 5,074,437.

A handle 20 may be unitarily formed with the housing 14 or may be attached separately to the housing. A trigger 22 is mounted in or adjacent to handle 20. A spring, such as a compression spring 24 acts as a trigger return spring to bias the trigger to a normally unactuated position such that the valve in valve assembly 12 is normally in a closed position. Attached to or formed unitarily with trigger 22 is a trigger extension 26, which may include guide, tabs (not shown) that ride in guide channels 28 formed within handle 20. A trigger actuator linking rod 30 is connected at one end to a portion of trigger extension 26 and at another end to a trigger actuator slide 32. Trigger actuator slide 32 includes a gooseneck extension 34 to which is attached a trigger actuator rod 36. Trigger actuator rod 36 is connected to the snap action ball valve assembly in a manner described hereinafter.

Water gun 10 also includes a pump 38, which, in the embodiment of FIG. 1 is an air pump. However, as set forth above, the pump could be a water pump or a combination water and air pump. Pump 38 includes a pump cylinder 40 and a piston 42 connected by a piston rod 44 to a pump handle 46. When the pump handle is reciprocated back and forth from the front of the water gun oriented to the left of FIG. 1 to the rear of the water gun oriented to the right of FIG. 1, air is compressed within the pump. The air compressed by the pump enters an air conduit 48 and passes through a one-way check valve 50 into tank 16. In this way, water or other liquid in tank 16 in essence becomes pressurized, in that the compressed air provides a motive force to the liquid.

A pressure relief valve 52 may be located in pump 38 or elsewhere within the pressurized components. The pressure relief valve may be any type of several available pressure relief valves well known to those skilled in this technology.

Pressure exerted on the liquid may be any desired pressure that is suitable for the intended application, including the type of liquid, the type of application to which the liquid is being applied, the nature, type and strength of the materials used to make the apparatus, the size and capacity of the pump, the size and capacity of the internal liquid conduits, the size, materials used and construction of snap action ball valve assembly 12, and the size and structure of the nozzle 54 from which the stream of water or other liquid is expelled from the water gun or other apparatus.

In Larami Limited's present XP™ water guns using plug valves of the type disclosed in U.S. Pat. No. 5,339,987, the pressure used is limited by the pressure release valve, which is set to relieve pressure above about 35 pounds per square inch gauge (psig). Pressurized water guns may operate at relatively low pressure ranges of about 20 to about 40 psig, relatively medium pressure ranges of about 40 to about 70 psig and relatively high pressure ranges above about 70 psig. The snap action ball valve of the present invention is intended to be used with pressures higher than those used with water guns having a plug valve. Thus, for example, for a comparable water gun of the type using a plug valve disclosed in U.S. Pat. No. 5,339,987, instead of operating at a pressure of about 35 psig, using conduits having a typical, widely commercially available internal diameter of 0.354 inch (90 mm), where the ball valve has inlet and outlet and channel internal diameters of the same dimension, and where the inlet internal diameter of the nozzle is of the same dimension but the outlet port internal diameter is 0.090 inch (23 mm), one embodiment of a water gun of the present invention is designed to operate at a pressure of 50 psig. At this pressure, water is shot in a stream of about 40 feet (12.2 meters). This is about 5 feet (1.5 m) farther than current water guns using the optimum components for the plug valve type of water release valve. The foregoing pressures and dimensions are provided only for purposes of illustration and not by way of any limitations.

Water gun 10 also includes a liquid conduit 56 connected to valve assembly 12 and also connected to or otherwise in fluid communication with the source of liquid, here, pressurized water in tank 16. Conduit 56 is preferably made of a synthetic polymeric material, such as ABS, styrene or polyvinylchloride, and is preferably formed by an extrusion process. The connection of conduit 56 to valve assembly 12 may be a mechanical clamp, an adhesively secured collar, or other suitable connection between liquid conduit 56 and valve assembly 12. Tank 16 may be connected to valve assembly 12 by screw threads, a collar, a clamp or any other suitable means, all including O-rings, gaskets or other suitable sealing material to prevent leakage of water or air.

Figure 7:
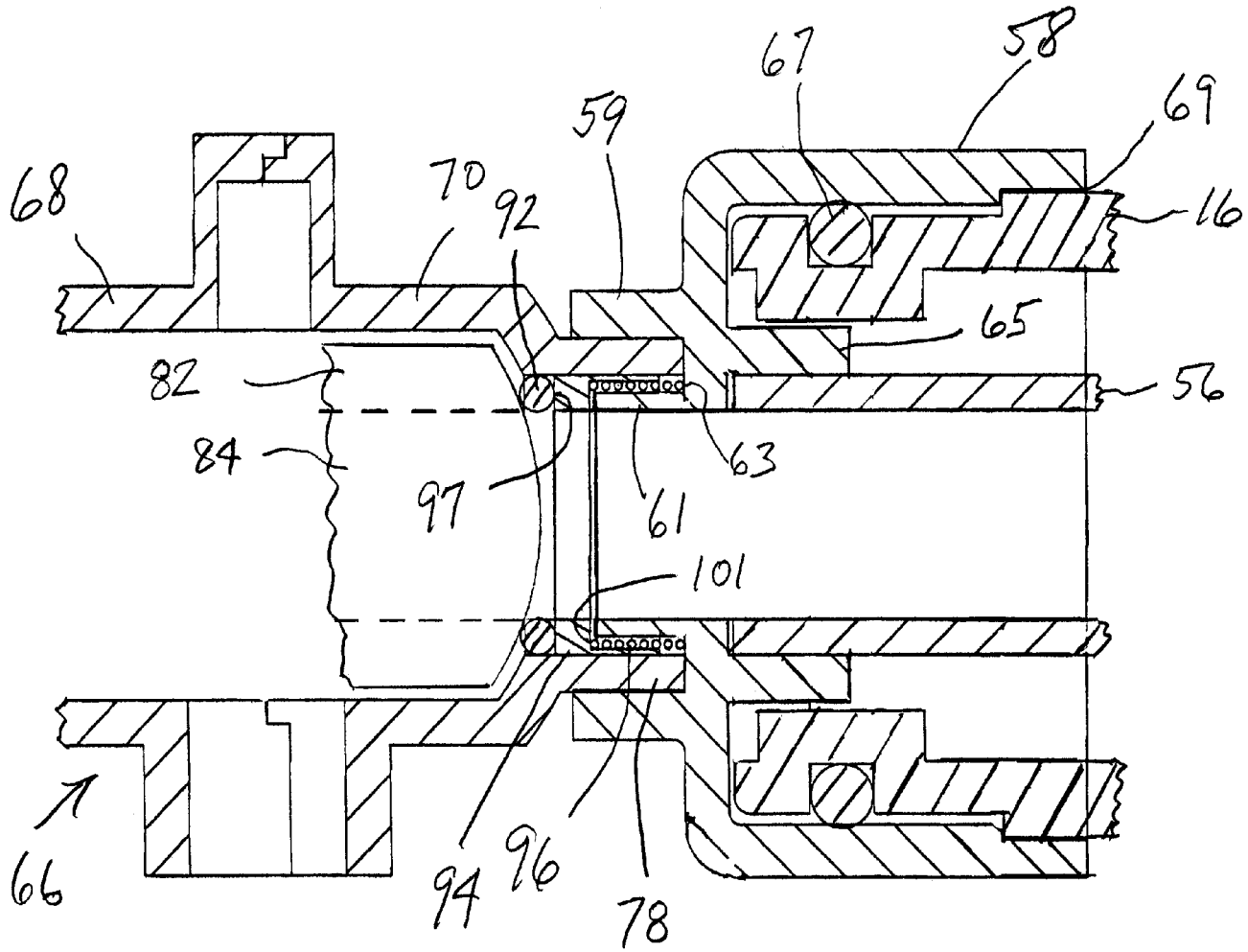
FIG. 7 is an enlarged horizontal cross-sectional view (when the valve assembly is oriented in a water gun in the orientation of FIG. 1) of a portion of the water gun shown in FIG. 1, showing the connection of the valve assembly to the water gun's water tank and the conduit in fluid communication with the water tank and the valve assembly.

The presently preferred connection of the valve assembly's valve housing 66 to the water gun's water tank 16 and conduit 56 that is in fluid communication with water tank 16 and valve housing 66 is best seen in FIG. 7, an enlarged horizontal cross-sectional view of a portion of the water gun shown in FIG. 1 (when the valve assembly is oriented in a water gun in the orientation of FIG. 1). The connection is preferably in the form of a collar 58, generally in the shape of a hollow cup. While the preferred cross-sectional shape of the collar is circular in the orientation shown looking from the front to the rear of the water gun, any other desired shape could be used. Collar 58 includes a first external arcuate flange 59 to be attached to an inlet 78 of a valve housing rear section 70 of the valve assembly by any suitable means, such an adhesive bond, a clamp or screw threads, for example. The collar is preferably formed in an injection molding process using ABS or other suitable synthetic polymer, although other materials and forming techniques could be used. Adhesive bonding is presently preferred, using any adhesive that is capable of bonding the components together. A first internal arcuate flange 61 including a spring seat 63 forms a portion of a spring retention area for a spring 96 whose purpose will be described hereinafter.

Collar 58 also includes a second internal arcuate flange 65 extending in a direction opposite that of first internal arcuate flange 61. Second internal arcuate flange 65, together with the inside wall of collar 58, forms an area for retaining the open end of tank 16. An 0-ring seal 67 seals the outside wall of tank 16 against the inside wall of collar 58, to prevent liquid or air leakage. As mentioned above, collar 58 can be attached to the open end of tank 16 by any of several techniques, such as a clamp, screw threads or as shown in FIG. 7, by adhesive bonding 69, using any adhesive that is capable of bonding the components together. Conduit 56 is likewise attached to connection 58 as best seen in FIG. 7. Conduit 56 is preferably attached to the inside wall of second interior arcuate flange 65 by any suitable adhesive, but optionally it could be attached by a clamp or collar or other mechanical connection.

The end of conduit 56 not connected to valve assembly 12 extends within tank 16 and is open to admit the pressurized water or other liquid and is preferably covered by a screen 60 so that dirt or other particles that may clog or otherwise adversely affect the operation of the water gun valve assembly and nozzle do not enter conduit 56.

As also shown in FIG. 1, it is preferred that the internal diameter of conduit 56 is of a size with respect to the internal diameter of the valve assembly inlet and the valve assembly outlet so as to substantially eliminate turbulence and pressure changes that significantly adversely affect a flow of liquid to be dispensed from the water gun or other apparatus relating to travel of the liquid through the valve assembly. Preferably, the internal diameter of conduit 56 is the same as the internal diameter of the valve assembly inlet and the internal diameter of the valve assembly outlet. Moreover, it is preferred that the snap action ball valve assembly contain a ball valve member having a channel with a diameter the same as the internal diameter of the valve assembly inlet and the internal diameter of the valve assembly outlet. Conduit 56 preferably is connected directly in a straight line connection to the valve assembly inlet as shown in FIG. 1. Thus, small radius bends, right angle elbows, Y-tubes and other diversions in the liquid conduit pathway are to be avoided to reduce adverse effects in the flow of liquid from the water gun caused by pressure changes or turbulence.

As also shown in FIG. 1, a nozzle 54 is attached to the water gun in fluid communication with valve assembly 12. Nozzle 54 may be connected to valve assembly 12 directly or indirectly through another conduit. It is preferred that regardless of whether the connection is a direct connection or an indirect connection, the internal diameter of the flow path from the valve assembly to the inlet of nozzle 54 be of the same internal diameter as the internal diameters of conduit 56, the inlet and outlet for valve assembly 12 and the channel within the ball valve member of the valve assembly. The internal diameter for the inlet and outlet of the valve assembly is based on the internal diameter of the various components that may be located within valve assembly inlet or outlet or in the connection collar 58, such as O-ring seals, springs, seats for the seals and springs, etc. Nozzle 54 has an internal truncated conical opening 62 whereby the internal diameter at the inlet to the nozzle is substantially larger than the diameter at the outlet portion of the nozzle, and preferably is the same internal diameter as the other components just mentioned. Nozzle 54 may have an extended nozzle outlet port 64 preferably having an internal diameter the same as the relatively smaller outlet end of internal truncated conical opening 62.

While the detailed operation of spring-controlled snap action ball valve assembly 12 will be described hereinafter, the overall operation of water gun 10 as shown in FIG. 1 will now be described, bearing in mind that this is only one example of one type of an air pressure water gun that may incorporate the valve assembly of the present invention. Cap 18 is unscrewed and water tank 16 is filled about two-thirds to about three-fourths of its capacity with water. Cap 18 is then screwed on to tank 16 so that tank 16 may maintain the pressure within the design limits of the materials and construction of the water gun. Pump handle 46 of air pump 38 is then reciprocated to cause compressed air to travel through air conduit 48 through one-way check valve 50 into tank 16, thereby creating a compressed air motive force pressurizing the water in tank 16.

To shoot water from the gun, trigger 22 is depressed by pulling it toward the back of gun 10, such that trigger extension 26 moves rearwardly within handle 20 to the partial phantom position shown. As trigger extension 26 moves rearwardly, so does trigger actuator linking rod 30, trigger actuator slide 32, trigger actuator gooseneck extension 34 and trigger actuator rod 36. As explained hereinafter, this movement causes a ball valve member within valve assembly 12 to snap open substantially instantaneously after reaching a threshold of movement. With this substantially instantaneous opening, a burst of water, not substantially affected by an adverse pressure drop or turbulence, flows through the valve and valve assembly into opening 62 in nozzle 54. Water is then expelled in a stream out of outlet port 64 of nozzle 54.

When trigger 22 is no longer depressed, compression spring 24 causes the trigger to move in a forward direction toward the left side of gun 10 as shown in FIG. 1. This in turn causes forward movement of trigger extension 26, trigger actuator linking rod 30, trigger actuator slide 32, trigger actuator gooseneck extension 34 and trigger actuator rod 36. The forward movement of trigger actuator rod 36 past a predetermined threshold causes the ball valve within valve assembly 12 to substantially instantaneously snap into its normally closed position, substantially instantaneously halting the flow of water through the valve assembly and nozzle 54, thereby preventing any additional pressure drop within tank 16.

Details of spring-controlled snap action ball valve assembly 12 will now be described, primarily with reference to FIGS. 2–6, after explaining the orientation of the valve assembly 12 in the water gun 10 by reference to FIG. 1.

Ball valve assembly 12 is shown in FIG. 1 as being oriented so that actuator rod 36 is connected to the lowermost component of the valve assembly. In other embodiments of water guns and other liquid dispensing apparatus, valve assembly 12 may be rotated in any convenient direction for actuation, so long as the flow path for the liquid through the valve is aligned with the outlet end of conduit 56 and the inlet end of nozzle 54. In the embodiment of valve assembly 12 illustrated in FIGS. 2–6, the viewer is looking at the valve assembly along the lines 2—2 of FIG. 1. Thus, while what is facing the viewer in each of FIGS. 2–6 is a bottom view of valve assembly 12 when the valve assembly is oriented as shown in FIG. 1, in other orientations of the valve assembly, the viewer may be looking at a side or top view of the valve assembly illustrated in FIGS. 2–6.

Figure 2:
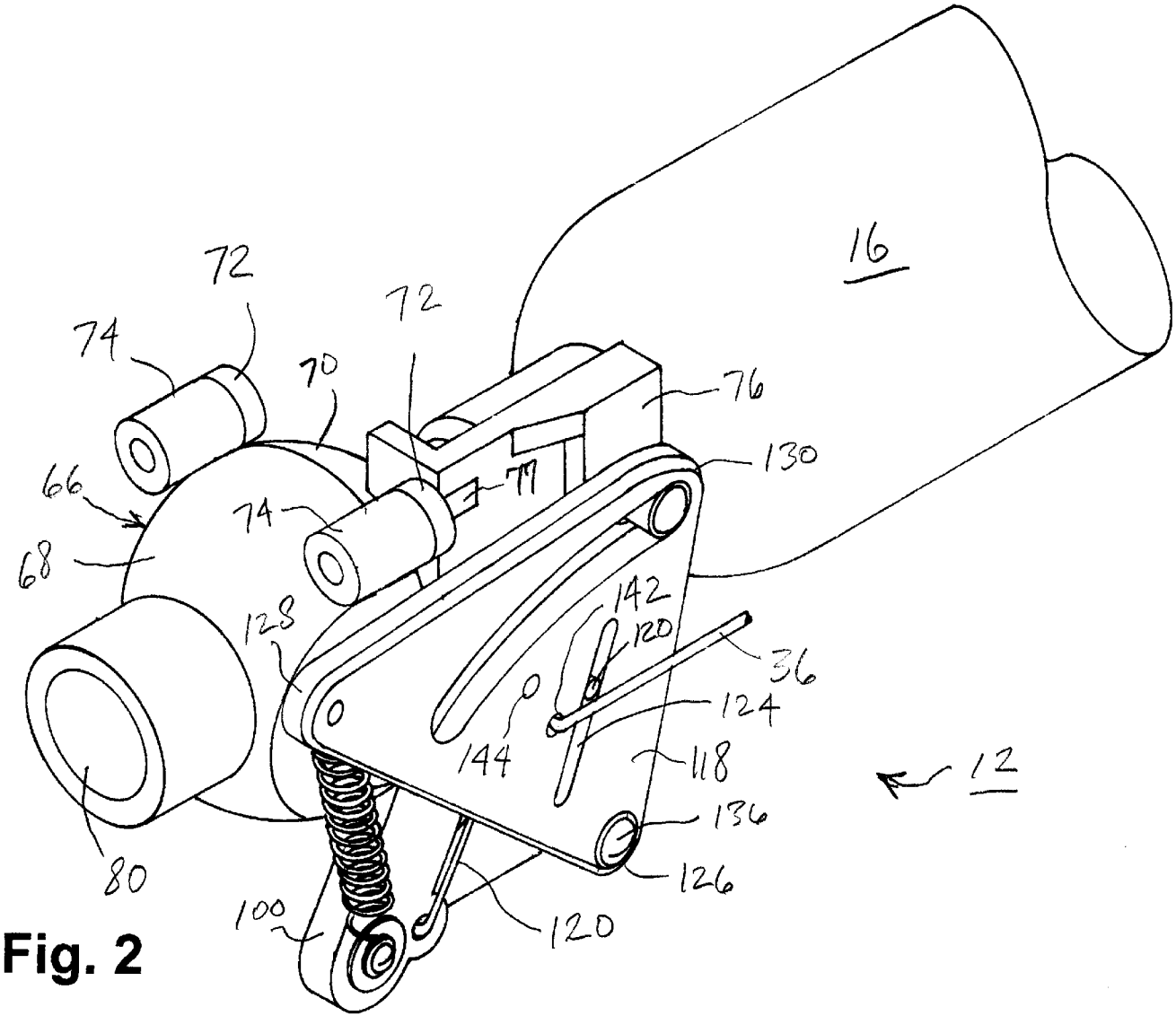
FIG. 2 is a front, bottom isometric view of the valve assembly of the present invention taken along lines 2—2 in FIG. 1, also schematically showing the valve assembly connected to a water tank.
Figure 3:
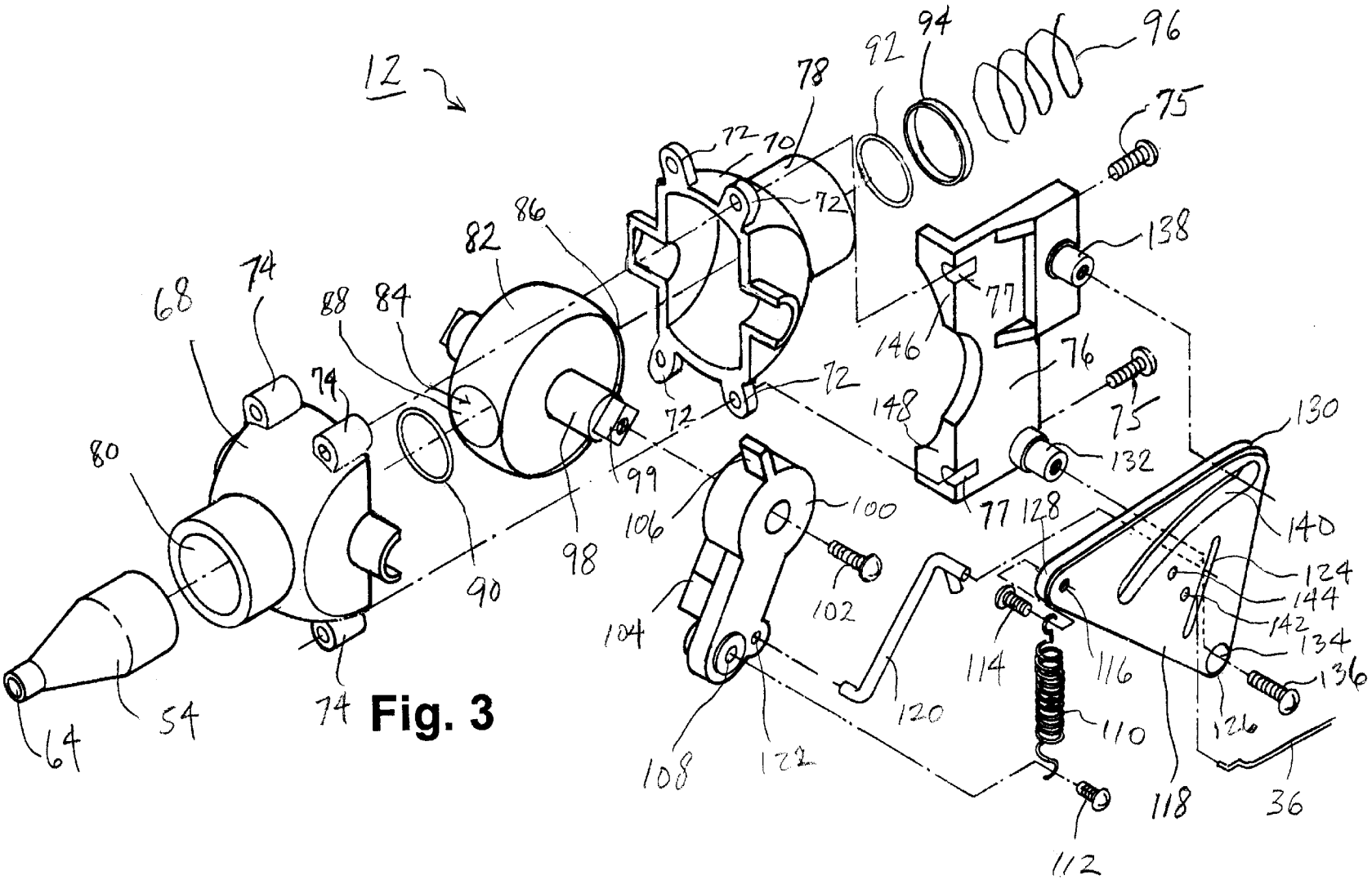
FIG. 3 is an exploded front, bottom isometric view of the valve assembly in accordance with the present invention.

The components of valve assembly 12 are best seen in FIGS. 2 and 3, respectively, an isometric front, bottom view and an exploded isometric front, bottom view of the valve assembly when it is located in a dispensing apparatus, such as water gun 10, in the orientation illustrated in FIG. 1. Valve assembly 12 includes a valve housing 66 comprising a front valve housing section 68 and a rear valve housing section 70. The valve housing is preferably made from a synthetic polymer, such as ABS, for example without limitation, made by injection molding. Other materials and formation materials could be used, as well, if desired. Rear valve housing section 70 includes a plurality, such as four, apertured connection flanges 72 in which the apertures are aligned with apertures within a like plurality of sockets 74 formed on front valve housing section 68. The front and rear valve housing sections 68 and 70 may be held together by screws, such as screws 75 as best illustrated in FIGS. 3–6. A mounting bracket 76 is also connected to valve housing 66 by screws 75 passing through mounting bracket apertures 77 prior to passing through the apertures in certain of the apertured connection flanges 72 and sockets 74 as best seen in FIG. 3. However, if desired, mounting bracket 76 could be formed as a unitary structure with either of the front and rear valve housing sections 70 or 68.

With further reference primarily to FIG. 3, valve housing 66 defined by front valve housing section 68 and rear valve housing section 70, includes a valve housing inlet 78 and a valve housing outlet 80, respectively formed in the rear valve housing section 70 and front valve housing section 68. A ball valve member 82 is disposed for rotation within valve housing 66 about an axis perpendicular to the flow path of liquid from valve housing inlet 78 through valve outlet 80. Ball valve member 82 preferably is injection molded from a synthetic polymeric engineering resin, such as DELRIN® acetal resin available from E.I. du Pont de Nemours Company in Wilmington, Del., U.S.A., but any other suitable material and any other suitable forming technique may be used. Although ball valve member 82 is not completely spherical, it is still considered a ball valve member in that it rotates within valve housing 66. Based on the use of seals described hereinafter and close tolerances between ball valve member 82 and valve housing 66 and with the optional use of gaskets, if desired, there is substantially no leakage which would result in any substantial adverse pressure changes, typically a pressure drop, within a pressurized system using valve assembly 12.

Ball valve member 82 includes a channel 84 having a diameter that preferably is identical to the internal diameter of valve housing inlet 78 and valve housing outlet 80, for the reasons discussed above with respect to controlling turbulence and pressure changes. Channel 84 includes a channel inlet end 86 and a channel outlet end 88. When the valve is in an open position, channel inlet end 86 is aligned with valve housing inlet 78 and channel outlet end 88 is aligned with valve housing outlet 80.

To prevent leakage, an O-ring seal 90 is located on a seal seat 91 (shown in FIG. 6) located within valve housing front section 68. As best seen in FIGS. 3 and 7, in order to assure a secure seal, an O-ring 92 seal, seated against an O-ring seal and spring cup 94 having a seal seat 97, is urged by a compression spring 96 seated within the interior of valve housing rear section 70 against the circumferential surface of ball valve member 82. O-ring seals 90 and 92, O-ring seal and spring cup 94 and compression spring 96 have internal diameters at least as large as, and preferably the same as ball valve member channel 84 and the internal diameters of conduit 56 and valve housing outlet 80, so as not to interfere with the flow of liquid through the valve. As shown best in FIG. 3, O-ring and spring seal cup 94 preferably has a side wall 95 extending away from a spring seat 101. The inside of side wall 95, together with the outside of first internal flange 61 of collar 58, forms an area for retaining spring 96, so that the spring will be able to provide a spring biasing force against the O-ring seal and spring cup and thereby urge O-ring seal 92 into a positive sealing engagement with ball valve member 82. The compressive force of spring 96 also helps to assure that ball valve member 82 has a positive sealing engagement with O-ring seal 90 by taking up any free motion space of the ball valve member 82 within valve housing 66. O-ring seals 90 and 92, O-ring seal and spring cup 94 and compression spring 96 have internal diameters at least as large as ball valve member channel 84 and the internal diameters of conduit 56 and valve housing outlet 80, so as not to interfere with the flow of liquid through the valve. Preferably their internal diameters are the same as ball valve member channel 84 and the internal diameters of conduit 56 and valve housing outlet 80, so as and not to increase turbulence or pressure changes within the dispensing apparatus.

A shaft 98 aligned with the rotational axis of ball valve member 82 extends from valve housing 66. Shaft 98 includes at its outer extension a non-circular key 99 which fits into a slot (not shown) having the same shape and slightly larger dimensions formed within a ball lever 100. Ball lever 100 is secured to the end of shaft 98 by a screw 102. Alternatively, ball lever 100 could be attached to shaft 98 by an adhesive or any other suitable way of forming a positive attachment.

Ball lever 100 is oriented, by virtue of the appropriate shape of key 99 and its mating slot, to assure proper alignment of ball valve member 82, such that channel 84 is accurately aligned with valve housing inlet 78 and valve housing outlet 80 in the open position, while not being so aligned when the valve is in a closed position. This is accomplished by a suitable stop member or members formed on ball lever 100 which interact with portions of mounting bracket 76 as described hereinafter. Alternatively, appropriate stop portions could be formed on valve housing 66 itself.

In the embodiment illustrated herein, an open position stop member 104 and a closed position stop member 106 are unitarily formed with or mounted on ball lever 100.

Ball lever 100 also includes a spring connecting aperture 108 by which a spring, such a an expansion spring 110, is connected at one end of ball lever 100 at a location spaced from the location where ball lever 100 is attached to shaft 98. The other end of expansion spring 110 is connection by a screw 114 to a spring connection aperture 116 formed in a snap lever 118. Thus, spring 110 connects ball lever 100 and snap lever 118.

Ball lever 100 and snap lever 118 may also optionally be, and preferably are connected by a linking member 120. One end of linking member 120 is rotatably retained in a linking member connection aperture 122 formed in ball lever 100. The other end of linking member 120 is retained for reciprocating movement within a slot 124 formed in snap lever 118. The operation of the optional linking lever 120 will be described hereinafter.

Snap lever 118 preferably has at least three corners, and more preferably, specifically has three corners 126, 128, and 130, although the snap lever may have any other shape, so long as its operation is equivalent to that described hereinafter, by virtue of the placement of certain components within a generally triangular arrangement in snap valve 118. Thus, for example, snap valve 118 could be a rectangular plate with four corners or a circular disk, technically without any corners, so long as components described hereinafter as being adjacent the corners illustrated at 126, 128 and 130 are generally maintained.

Snap lever 118 is mounted for rotation on a shaft 132 extending from mounting bracket 76. Alternatively, shaft 132 could extend directly from rear valve housing section 70. Shaft 132 extends through a rotation aperture 134 formed in snap lever 118 adjacent to corner 126. Snap lever 118 is retained for rotation about shaft 132 by a screw 136. Thus, shaft 132 serves as a pivot point for the rotation of snap lever 118. The extent of rotation of snap lever 118 is limited by virtue of the travel of a stop member 138 extending from mounting bracket 76 (or alternatively extending from rear valve housing section 70) into an arcuate slot 140 formed in snap lever 118. Arcuate slot 140 extends from a location adjacent corner 130 or any equivalent location with respect to the orientation of rotation aperture 134 and spring connection aperture 116. The other end of slot 140 extends into the interior of snap lever 118 approaching a line extending between spring connection aperture 116 adjacent corner 128 and rotation aperture 134 adjacent corner 126.

Snap lever 118 also includes at least one connection aperture by which actuator rod 36, actuated by trigger 22, is connected to snap lever 118. In the embodiment shown herein, snap lever 118 includes two connection apertures 142 and 144. Connection aperture 142 is used when a relatively short throw (that is, a short distance of movement) of snap lever is desired to actuate the valve. Actuator rod 36 is connected to long throw actuator rod connection aperture 144 when a relatively long throw of snap lever 118 is desired to actuate the valve.

Figure 4:
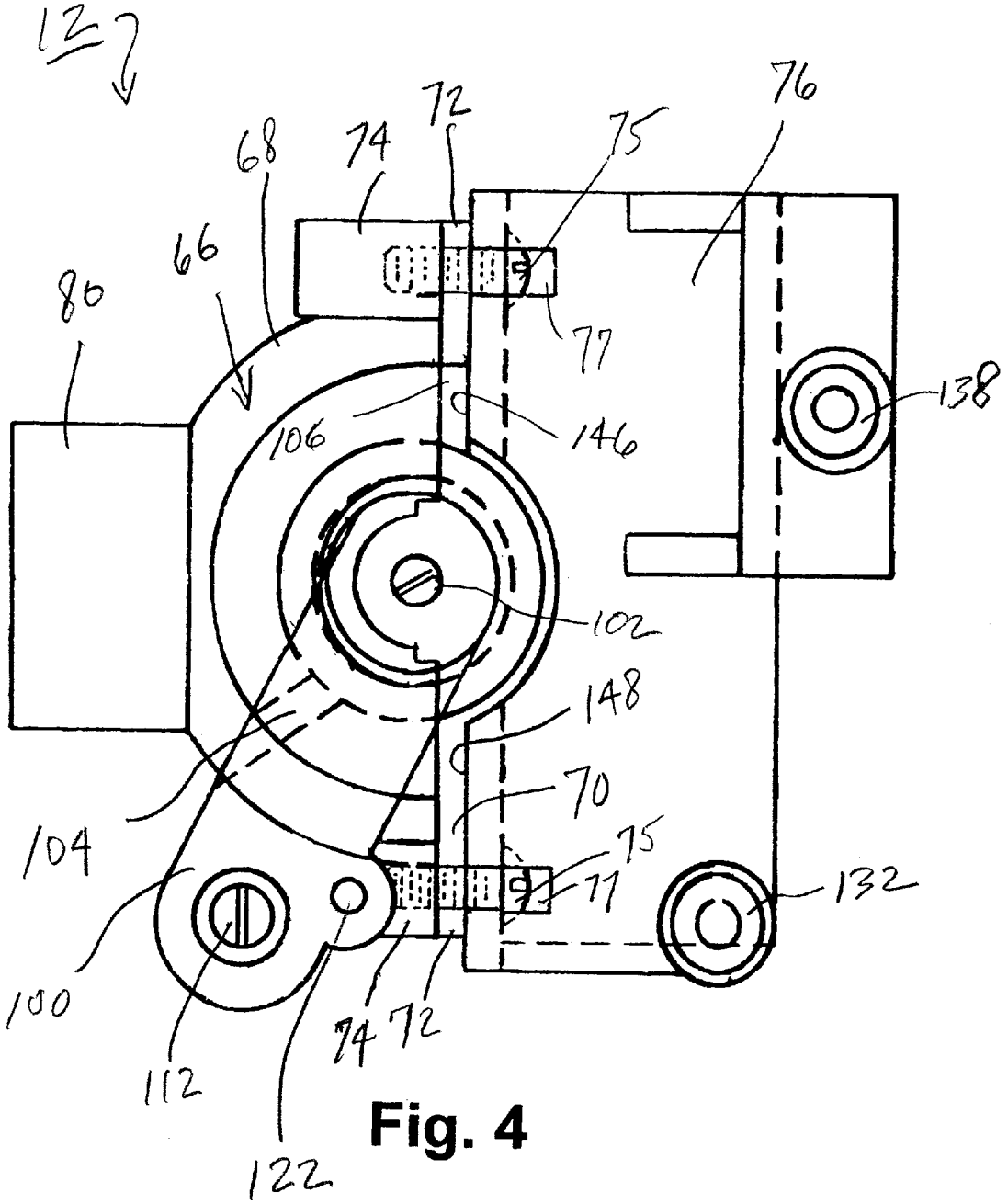
FIG. 4 is a bottom elevation view (when the valve is assembled in a dispensing apparatus as shown in the orientation taken along lines 2—2 of FIG. 1) of the valve assembly of the present invention with the snap lever and spring removed.

FIG. 4 is a bottom elevation view of valve assembly 12 with snap lever 118 and spring 110 removed to show the relationship among valve housing 66, mounting bracket 76 and ball lever 100. As shown in FIG. 4, ball lever 100 is in a position such that the valve is closed. In this position, ball lever stop member 106 is abutting a closed position stop member abutment region 146 on mounting bracket 76 (also seen in FIG. 3). When the valve is in an open position, ball lever 100 rotates counterclockwise in the orientation shown in FIG. 4 such that ball lever stop member 104 abuts open position stop member abutment region 148 of mounting bracket 76. This region is best seen in FIGS. 3, 4 and 6.

Ball lever 100, snap lever 118 and mounting bracket 76 are preferably injection molded from a very strong and durable synthetic polymeric engineering resin. DELRIN® acetal resin is the presently preferred material, but any other suitable material and any other suitable forming technique may be used.

Figure 5:
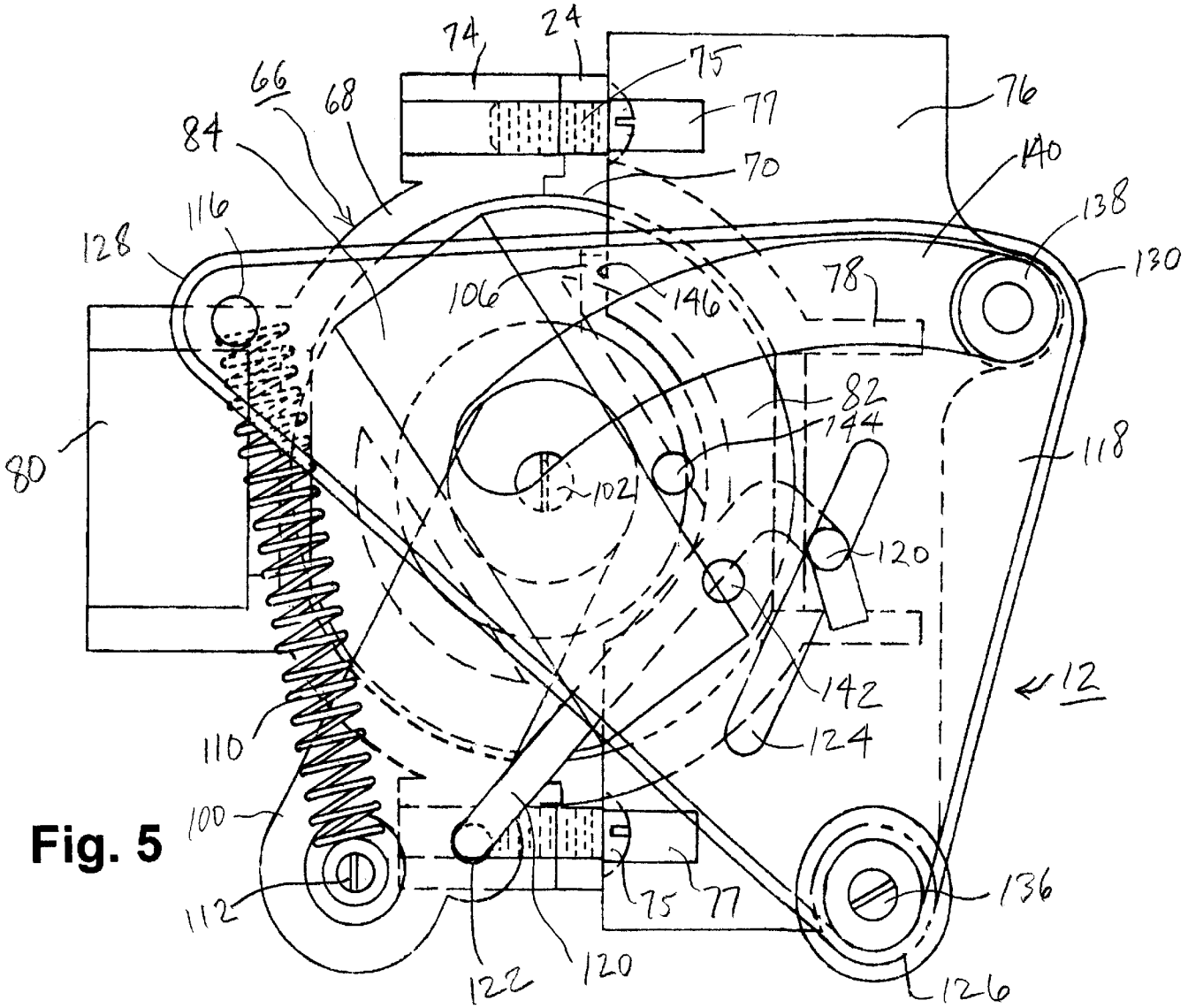
FIG. 5 is a bottom elevation view as explained with respect to FIG. 4, of the valve assembly depicting the valve in a closed position.
Figure 6:
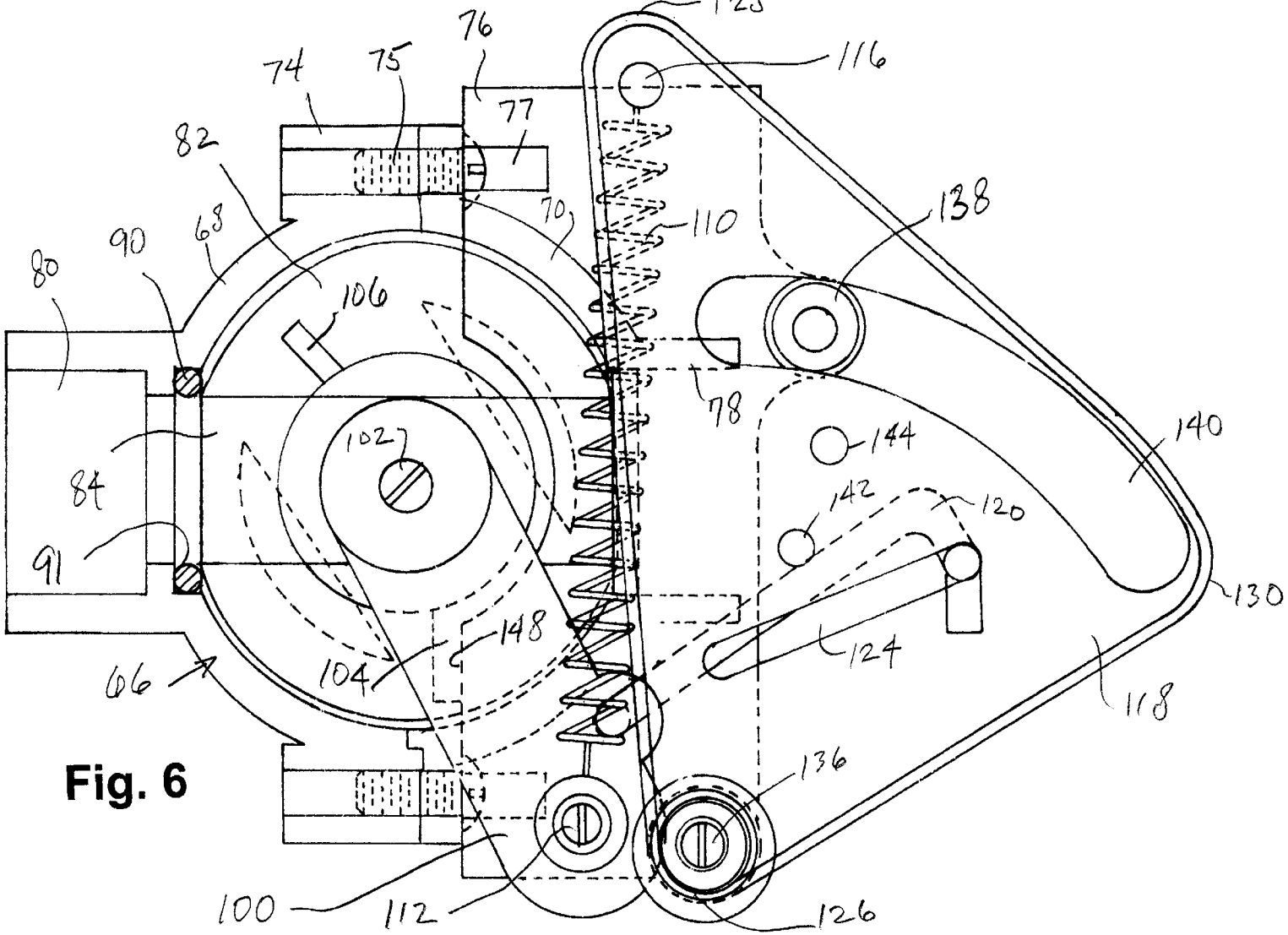
FIG. 6 is a bottom elevation view as explained with respect to FIG. 4, of the valve assembly depicting the valve in an open position.

The operation of valve assembly 12 will now be described, initially with particular reference to FIG. 5, in which the valve is shown in a normally closed position and with reference to FIG. 6 showing the valve in an open position.

With reference to FIG. 5, channel 84 of ball valve member 82 is depicted as being out of alignment with valve housing inlet 78 and valve housing outlet 80. Thus, the longitudinal axis of channel 84 is at an angle of about 60° with respect to an axis corresponding to the flow path between valve housing inlet 78 and valve housing outlet 80. While this angle is shown, any other suitable angle could be used, so long as channel 84 is out of alignment with valve housing inlet 78 and valve housing outlet 80 and the valve is thereby in a closed position. In this position, stop member 106 on ball lever 100 is abutting closed position stop member abutment region 146 on mounting bracket 76. Also in this closed position, snap lever 118 has been moved in an arcuate direction counterclockwise with respect to the orientation shown in FIG. 5 about the pivot point adjacent corner 126 as far counterclockwise as it can be. This position is defined by the abutment of stop member 138 against the inside wall of arcuate slot 140 adjacent corner 130. Also in this position, extension spring 110 connecting ball lever 100 and snap lever 118 is in a relatively contracted condition, with spring connection aperture 108 relative close to the rotation aperture adjacent to corner 126 of snap lever 118. Ball lever 100 has been moved in a direction clockwise (and opposite to the direction of movement of snap lever 118) to its fullest extent based upon stop member 106 bearing against closed position stop member abutment region 146 of mounting bracket 76.

When it is desired to open the valve to discharge liquid from apparatus in which valve assembly 12 is used, the user would actuate movement of the snap valve in a clockwise position in the orientation of FIG. 5 by virtue of pulling actuator rod 36 (best seen in FIGS. 1, 2 and 3) connected to short throw actuator rod connection aperture 142 or long throw actuator rod connection aperture 144, in a right-hand direction in the orientation of FIG. 5. This movement is generated, for example, by depressing trigger 22, as described above with respect to the overall operation of water gun 10 as depicted in FIG. 1. Depression of trigger 22 or other means of causing actuator rod 36 to move an appropriate distance toward the right-hand side of FIGS. 5 and 6 causes snap valve 118 to begin to rotate clockwise in the orientation of FIGS. 5 and 6. As snap lever 118 continues to rotate in a clockwise direction, spring 110 expands and linking member 120 slides from a position located generally in the middle of slot 124 of snap lever 118 to a position approaching the end wall of slot 124 closest to corner 126 of snap valve 118.

At some point in its clockwise rotation, spring connection aperture 116 adjacent to corner 128 of snap valve 118 moves to a location aligned with a line extending through spring connection aperture 108 (and screw 112) at the end of ball lever 100 and screw 102 connecting ball lever 100 to shaft 98. As snap lever 118 continues to rotate clockwise past this threshold alignment position, if the biasing force of spring 110 is strong enough, expansion spring 110, which has been stretched, will contract rapidly and will cause ball lever 110 to move almost instantaneously (that is, snap) from the position shown in FIG. 5 counterclockwise to the position shown in FIG. 6. Based on this movement, ball valve member 82 will rotate almost instantaneously, such that channel 84 of ball valve member 82 is aligned with valve housing inlet 78 and valve housing outlet 80, and the valve will be in an open position. When actuator rod 36 has been moved sufficiently towards the right in the orientation of FIGS. 5 and 6, such that snap lever 118 rotates clockwise to a sufficient extent to cause ball lever 100 to snap to an open position, ball lever stop member 104 is moved to a position where it abuts open position stop member abutment region 148 on mounting bracket 76. This is the position of ball lever 100 shown in FIG. 6.

If a strong enough spring, such as extension spring 110, is used, and if the components of the valve assembly are strong enough to withstand the tension created by the expanding spring, the snapping movement and abrupt end of movement of ball lever 100, it is not necessary to have a linking member 120. The spring force will be sufficient to overcome any resistance to movement which may be generated by friction of ball valve member 82 in valve housing 66, particularly with respect to the pressure exerted by compression spring 96 against O-ring seal cup 94 and O-ring seal 92 against the rotating circumference of ball valve member 82, as well as friction between O-ring seal 90 and the rotating circumference of ball valve member 82.

If the ball valve has not been actuated for a considerable time, or if water hardness causes a build-up of mineral deposits within valve housing 66 between valve housing 66 and ball valve member 82, or if a spring of lower biasing force is desired due to the materials used to make the components of valve assembly 12, linking member 120 helps overcome any such friction or sticking and helps urge ball lever 100 past the threshold position such that the biasing force of spring 110 is sufficient to cause ball lever 100 to move in a position opposite to its then current resting position. The action of linking member 120 will be described in more detail with respect the description of closing the valve after it has reached its open position in FIG. 6.

For toy water guns and most other applications in which a snap action valve assembly is used, where it is desired to have the valve in a fully opened position or a fully closed position and where the valve should move substantially instantaneously between a fully open position and a fully closed position and vice versa, it is usually desired to have the valve in a normally closed position. Thus, in the environment of a toy water gun, one normally wants the valve to be in a closed position and opened only when the trigger is depressed. When the trigger is released, it is desirable for the valve to snap shut almost instantaneously so as to avoid pressure loss which may adversely affect the use of the toy water gun. The same situation would typically apply when the valve assembly is used for other applications. The snap action valve assembly 12 of the present invention is designed to snap shut automatically when pressure on the actuator is released. This is due to the spatial relationship of snap lever 118 and its components as arranged with respect to ball lever 100 and its components, particularly the connection points of spring 110 and the pivot points for snap lever 118 and ball lever 100.

FIG. 6 illustrates an open condition of the valve and the position of snap lever 118 as it is beginning to rotate counterclockwise in the orientation of FIG. 6 to begin the closing action of the valve. This is indicated by the relative location of stop member 138 away from the end wall of slot 140 in a position toward the interior and away from corner 130 of snap lever 118. This condition is also indicated by the position of linking member 120 at the full extent of its travel in slot 124 in a direction toward corner 130 of snap lever 118. As snap lever 118 continues to move counterclockwise, which would be the case if actuator rod 36 (not shown in FIG. 6) were to move to the left in the orientation of FIG. 6, such as by releasing pressure on trigger 22 in FIG. 1, linking member 120 is pushed toward the left, whereby frictional forces within valve housing 66 against ball valve member 82 are initially overcome, making it easier for spring 110 to contract after the spring has been expanded.

When the valve is in the open position as shown in FIG. 6, spring 110 is angled slightly to the right of vertical, whereby the tendency of spring 110 to contract retains ball lever 100 in a position such that stop member 104 bears against open position stop member abutment region 148 on mounting bracket 76. When snap lever 118 begins to move counterclockwise in the orientation of FIGS. 5 and 6, the end of spring 110 connected at connection aperture 116 to snap lever 118 begins to shift to the opposite side of vertical. This tends to cause ball lever 100 to move initially in a clockwise rotation. Such clockwise rotation of ball lever 100 is aided by the movement of linking member 120 toward the left in the orientation of FIGS. 5 and 6 as linking member 120 bears against the end wall of slot 124 closest to corner 130 of snap lever 118. When the spring connection aperture 116 adjacent to corner 128 of snap lever 118 moves past the alignment threshold described above in alignment with a line extending through screws 112 and 102 in ball lever 100, ball lever 100 will rotate sufficiently clockwise that the contracting force of spring 110 will cause ball lever 100 to snap to the position shown in FIG. 5, thus substantially instantaneously closing the valve. In this position, stop member 106 on ball lever 100 bears against closed position stop member abutment region 146 of mounting bracket 76.

While various particular embodiments of springs, shapes and configurations of ball lever 110 and snap lever 118 have been shown for purposes of exemplary explanation, it is not essential to use the specific components or their arrangements as illustrated and described herein. Rather, it is only essential that a spring, ball lever and a snap lever be configured and cooperate such that when an actuator is actuated to open a valve, the valve snaps open and when the actuator is actuated to close the valve the valve snaps closed. Those skilled in the art could make many modifications to the components in view of the disclosure herein without undue experimentation.

It will be appreciated by those skilled in the art that other changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for dispensing pressurized liquid, the apparatus comprising:

a connection to a source of pressurized liquid, a spring-controlled snap action ball valve assembly including a snap action ball valve comprising a valve member having a channel therethough and being rotatable within a valve housing between an open position for the valve wherein the channel is aligned with a valve assembly inlet and a valve assembly outlet to permit the liquid to flow through the inlet, the channel and the outlet, and a closed position for the valve, wherein the channel is not aligned with the outlet to prevent the liquid from flowing through the channel and the outlet, a conduit in fluid communication from the connection to the valve assembly inlet, a nozzle in fluid communication with the valve assembly outlet, and a spring-controlled actuator connected to the valve member, the spring controlling actuation of the snap action ball valve so that the valve member has a snap action both from the closed position to the open position and from the open position to the closed position.

2. The apparatus of claim 1 further comprising a device for pressurizing liquid to be dispensed from the apparatus, the device being selected from the group consisting of a pump in fluid communication with a source of liquid, a pump for compressing air to provide a motive force to the liquid, and an elastic bladder connected to a source of liquid.

3. The apparatus of claim 2 wherein the source of pressurized liquid is a tank for containing liquid and compressed air that exerts a force on the liquid to force the liquid into the conduit in fluid communication with the source of pressurized liquid.

4. The apparatus of claim 1 wherein the apparatus is an air pressurized liquid dispensing apparatus, the source of pressurized liquid comprising a tank for liquid and air compressed by a pump, wherein the air exerts a force on liquid in the tank to force the liquid into the conduit in fluid communication with the source of pressurized liquid.

5. The apparatus of claim 4 wherein the apparatus is a toy water gun comprising a housing, the tank being attached to the water gun housing, and the actuator is actuated by a trigger.

6. The apparatus of claim 5 wherein the pump is an air pump attached to the water gun housing.

7. The apparatus of claim 5 wherein the tank is at least partially within the water gun housing.

8. The apparatus of claim 7 wherein the pump is an air pump attached to the water gun housing.

9. The apparatus of claim 1 wherein the source of the pressurized liquid comprises an elastic bladder that provides a pressurizing force when the bladder is expanded with liquid contained therein.

10. The apparatus of claim 9 wherein the apparatus is a toy water gun comprising a housing, the water gun further comprising a tank for water being attached to the water gun housing, and wherein the actuator is actuated by a trigger.

11. The apparatus of claim 10 further comprising a water pump attached to the water gun housing to pump water from the tank into a bladder.

12. The apparatus of claim 11 wherein the tank is at least partially within the water gun housing.

13. The apparatus of claim 1 further comprising at least one of an elastic bladder and a tank for liquid, and a quick fill device connectable to the source of pressurized liquid and removably associated with an inlet valve in a conduit in fluid connection with at least one of the tank and the elastic bladder.

14. The apparatus of claim 1 wherein the conduit has an internal diameter of a size with respect to the internal diameter of the valve assembly inlet and the valve assembly outlet so as to substantially eliminate turbulence and pressure changes that significantly adversely affect a flow of liquid to be dispensed from the apparatus relating to travel of the liquid through the valve assembly.

15. The apparatus of claim 14 wherein the internal diameter of the conduit is the same as the internal diameter of the valve assembly inlet and the internal diameter of the valve assembly outlet.

16. The apparatus of claim 14 wherein the snap action ball valve assembly contains a ball valve member having a channel with a diameter the same as the internal diameter of the valve assembly inlet and the internal diameter of the valve assembly outlet.

17. The apparatus of claim 1 wherein the conduit is connected directly in a straight line connection to the valve assembly inlet.

18. The apparatus of claim 1 wherein the nozzle is connected directly to the valve assembly outlet and wherein the nozzle has an internal truncated conical shaped opening with a relatively wider opening and a relatively narrower opening, the relatively wider opening being the nozzle inlet for liquid entering the nozzle, the nozzle inlet having an internal diameter the same as the internal diameter of the valve assembly outlet.

19. An apparatus for dispensing pressurized liquid, the apparatus comprising:

a connection to a source of pressurized liquid, a spring-controlled snap action ball valve assembly including a snap action ball valve and an inlet and an outlet, a conduit in fluid communication from the connection to the valve assembly inlet, a nozzle in fluid communication with the valve assembly outlet, and an actuator connected to the valve assembly to actuate the snap action ball valve from a closed position to an open position and from an open position to a closed position, wherein the snap action ball valve assembly comprises a valve housing with a flow path through the valve housing, the valve housing having an inlet and an outlet, a ball valve member having a channel therethrough and being rotatable within the valve housing, the channel having an inlet end and an outlet end and being aligned with the valve housing inlet and valve housing outlet in an open valve position and not being aligned with the valve housing inlet and valve housing outlet in a closed valve position, a liquid-tight seal adjacent each of the valve housing inlet and valve housing outlet and each bearing against the ball valve member, a shaft connected to the ball valve member and extending out of the valve housing to rotate the ball valve member in the valve housing, a ball lever having two ends and connected at one end to the shaft, a snap lever movable with respect to the ball lever, the snap lever being connected at least indirectly to the actuator, and a spring connecting the snap lever and the ball lever at a location spaced from the one end of the ball lever where the ball lever is connected to the shaft, the spring having a spring action, the spring action and the relative movement of the snap lever and the ball lever being interrelated such that movement of the actuator in a first direction causes the snap valve to move from a first snap lever position to a second snap lever position and thereby causing a first effectuation of the spring action, the first effectuation of the spring action in turn causing the ball lever to snap from a first ball lever position where the ball valve member is in the closed valve position to a second ball lever position where the ball valve member is in the open valve position, and the movement of the actuator in a second direction causes the snap valve to move from the second snap lever position to the first snap lever position, thereby causing a second effectuation of the spring action, the second effectuation of the spring action in turn causing the ball lever to snap from the second ball lever position where the ball valve is in the open valve position to the first ball lever position where the ball valve is in the closed valve position.

20. The apparatus of claim 19 wherein the ball valve assembly further comprises a linking member having two ends and being rotatably connected at one end of the linking member to the ball lever and slidably linked at the other end of the linking member in a slot in the snap lever, the linking member being operable to help urge the ball lever from the first ball lever position to the second ball lever position upon movement of the snap lever from the first snap lever position to the second snap lever position, and from the second ball lever position to the first ball lever position upon movement of the snap lever from the second snap lever position to the first snap lever position.

21. The apparatus of claim 19 wherein the ball valve assembly further comprises at least one stop member on the ball lever that bears against at least one corresponding stop portion on one of the valve housing and a mounting bracket attached to the valve housing, in respective first and second ball lever positions, such that in a first stop position in the first ball lever position, the channel in the ball valve member is not aligned with respect to the valve housing inlet and the valve housing outlet and the ball valve is in the closed position, and such that in a second stop position in the second ball lever position, the channel in the ball valve member is aligned with respect to the valve housing inlet and the valve housing outlet and the ball valve is in the open position.

22. The apparatus of claim 19 wherein the snap lever is rotatably mounted at one end to one of the valve housing and a mounting bracket attached to the valve housing such that the snap lever moves in a first arcuate direction when moving from the first snap lever position to the second snap lever position and in a second, opposite arcuate direction when the snap lever is moved from the second snap lever position to the first snap lever position, the spring is an extension spring having first and second ends and is connected at the first end to a portion of the snap lever spaced from the end at which the snap lever is rotatably mounted to one of the valve housing and the mounting bracket, and the spring is connected at the second end to the ball lever at a location spaced from the one end of the ball lever where the ball lever is connected to the shaft, such that the movement of the snap lever in the first arcuate direction moves the ball lever in the second arcuate direction opposite the first arcuate direction and movement of the snap lever in the second arcuate direction moves the ball lever in the first arcuate direction.

23. The apparatus of claim 19 wherein the snap lever has at least two ends and is rotatably mounted adjacent one end to a mounting bracket attached to the valve housing, the snap lever having a structure with respect to the mounting bracket that limits rotation of the snap lever with respect to the mounting bracket.

24. The apparatus of claim 19 wherein the snap lever has at least three corners and is rotatably mounted adjacent one corner to a mounting bracket attached to the valve housing, the snap lever having an arcuate slot extending from a location adjacent a second corner toward an interior portion of the snap lever, the mounting bracket having a stop projection extending from the mounting bracket into the arcuate slot in the snap lever to limit rotation of the snap lever.

25. The apparatus of claim 24 wherein the snap lever moves in a first arcuate direction when moving from the first snap lever position to the second snap lever position and in a second, opposite arcuate direction when the snap lever is moved from the second snap lever position to the first snap lever position, the spring is an extension spring having first and second ends and is connected at its first end to a location adjacent a third corner of the snap lever, and the spring being connected at the second end to the ball lever at a location spaced from the one end of the ball lever where the ball lever is connected to the shaft, such that the movement of the snap lever in the first arcuate direction moves the ball lever in the second arcuate direction opposite the first arcuate direction and movement of the snap lever in the second arcuate direction moves the ball lever in the first arcuate direction.

26. A spring-controlled snap action ball valve assembly comprising a valve housing with a flow path through the valve housing, the valve housing having an inlet and an outlet, a ball valve member having a channel therethrough and being rotatable within the valve housing, the channel having an inlet end and an outlet end and being aligned with the valve housing inlet and valve housing outlet in an open valve position and not being aligned with the valve housing inlet and valve housing outlet in a closed valve position, a liquid-tight seal adjacent each of the valve housing inlet and valve housing outlet and each bearing against the ball valve member, a shaft connected to the ball valve member and extending out of the valve housing to rotate the ball valve member in the valve housing, a ball lever having two ends and connected at one end to the shaft, a snap lever movable with respect to the ball lever, the snap lever being connected at least indirectly to an actuator, and a spring connecting the snap lever and the ball lever at a location spaced from the one end of the ball lever where the ball lever is connected to the shaft, the spring having a spring action, the spring action and the relative movement of the snap lever and the ball lever being interrelated such that movement of the actuator in a first direction causes the snap valve to move from a first snap lever position to a second snap lever position and thereby causing a first effectuation of the spring action, the first effectuation of the spring action in turn causing the ball lever to snap from a first ball lever position where the ball valve member is in the closed valve position to a second ball lever position where the ball valve member is in the open valve position, and the movement of the actuator in a second direction causes the snap valve to move from the second snap lever position to the first snap lever position, thereby causing a second effectuation of the spring action, the second effectuation of the spring action in turn causing the ball lever to snap from the second ball lever position where the ball valve is in the open valve position to the first ball lever position where the ball valve is in the closed valve position.

27. The spring-controlled snap action ball valve assembly of claim 26 wherein the ball valve assembly further comprises a linking member having two ends and being rotatably connected at one end of the linking member to the ball lever and slidably linked at the other end of the linking member in a slot in the snap lever, the linking member being operable to help urge the ball lever from the first ball lever position to the second ball lever position upon movement of the snap lever from the first snap lever position to the second snap lever position, and from the second ball lever position to the first ball lever position upon movement of the snap lever from the second snap lever position to the first snap lever position.

28. The spring-controlled snap action ball valve assembly of claim 26 wherein the ball valve assembly further comprises at least one stop member on the ball lever that bears against at least one corresponding stop portion on one of the valve housing and a mounting bracket attached to the valve housing, in respective first and second ball lever positions, such that in a first stop position in the first ball lever position, the channel in the ball valve member is not aligned with respect to the valve housing inlet and the valve housing outlet and the ball valve is in the closed position, and such that in a second stop position in the second ball lever position, the channel in the ball valve member is aligned with respect to the valve housing inlet and the valve housing outlet and the ball valve is in the open position.

29. The spring-controlled snap action ball valve assembly of claim 26 wherein the snap lever is rotatably mounted at one end to one of the valve housing and a mounting bracket attached to the valve housing such that the snap lever moves in a first arcuate direction when moving from the first snap lever position to the second snap lever position and in a second, opposite arcuate direction when the snap lever is moved from the second snap lever position to the first snap lever position, the spring is an extension spring having first and second ends and is connected at the first end to a portion of the snap lever spaced from the end at which the snap lever is rotatably mounted to one of the valve housing and the mounting bracket, and the spring is connected at the second end to the ball lever at a location spaced from the one end of the ball lever where the ball lever is connected to the shaft, such that the movement of the snap lever in the first arcuate direction moves the ball lever in the second arcuate direction opposite the first arcuate direction and movement of the snap lever in the second arcuate direction moves the ball lever in the first arcuate direction.

30. The spring-controlled snap action ball valve assembly of claim 26 wherein the snap lever has at least two ends and is rotatably mounted adjacent one end to a mounting bracket attached to the valve housing, the snap lever having a structure with respect to the mounting bracket that limits rotation of the snap lever with respect to the mounting bracket.

31. The spring-controlled snap action ball valve assembly of claim 26 wherein the snap lever has at least three corners and is rotatably mounted adjacent one corner to a mounting bracket attached to the valve housing, the snap lever having an arcuate slot extending from a location adjacent a second corner toward an interior portion of the snap lever, the mounting bracket having a stop projection extending from the mounting bracket into the arcuate slot in the snap lever to limit rotation of the snap lever.

32. The spring-controlled snap action ball valve assembly of claim 31 wherein the snap lever moves in a first arcuate direction when moving from the first snap lever position to the second snap lever position and in a second, opposite arcuate direction when the snap lever is moved from the second snap lever position to the first snap lever position, the spring is an extension spring having first and second ends and is connected at its first end to a location adjacent a third corner of the snap lever, and the spring being connected at the second end to the ball lever at a location spaced from the one end of the ball lever where the ball lever is connected to the shaft, such that the movement of the snap lever in the first arcuate direction moves the ball lever in the second arcuate direction opposite the first arcuate direction and movement of the snap lever in the second arcuate direction moves the ball lever in the first arcuate direction.

* * * * *